US011408638B2

(12) United States Patent
Pal-Calinescu et al.

(10) Patent No.: US 11,408,638 B2
(45) Date of Patent: Aug. 9, 2022

(54) GUTTER FOR AN EVAPORATIVE PANEL OF A COOLING SYSTEM

(71) Applicant: MUNTERS ITALY S.P.A., Chiusavecchia (IT)

(72) Inventors: Andrei Pal-Calinescu, Chiusavecchia (IT); Fabrizio Trifoglio, Chiusavecchia (IT); Andrea Revetria, Chiusavecchia (IT); Fulvio Brambilla, Chiusavecchia (IT)

(73) Assignee: MUNTERS ITALY S.P.A., Chiusavecchia (IT)

( * ) Notice: Subject to any disclaimer, the term of this patent is extended or adjusted under 35 U.S.C. 154(b) by 143 days.

(21) Appl. No.: 16/746,248

(22) Filed: Jan. 17, 2020

(65) Prior Publication Data

US 2021/0222909 A1 Jul. 22, 2021

(51) Int. Cl.
*F24F 13/22* (2006.01)

(52) U.S. Cl.
CPC ..... *F24F 13/222* (2013.01); *F24F 2013/227* (2013.01)

(58) Field of Classification Search
CPC ..... F24F 13/222; F24F 2013/227
See application file for complete search history.

(56) References Cited

U.S. PATENT DOCUMENTS 3,841,101 A 10/1974 Henfrey
10,562,789 B2 * 2/2020 Patey ..... F28F 3/08
2003/0167786 A1 * 9/2003 Nakagawa ..... F24F 1/0063 62/285
2006/0231240 A1 * 10/2006 Rothenhofer ..... F28F 13/14 165/146
2007/0163280 A1 7/2007 Meerpohl
2016/0091253 A1 * 3/2016 Spryshak ..... F28F 13/12 165/166
2016/0146552 A1 * 5/2016 Tutunoglu ..... F28F 9/04 165/173

(Continued)

FOREIGN PATENT DOCUMENTS

DE 29908553 U1 8/1999
FR 682616 5/1930

OTHER PUBLICATIONS

Machine translation of Description DE29908553, Sent, eSpacenet, Jul. 5, 1999, all (Year: 1999).*
EPO Search Report, EP 18425078, dated Apr. 12, 2019.

*Primary Examiner* — Filip Zec
(74) *Attorney, Agent, or Firm* — Cittone Demers & Arneri LLP; Henry J. Cittone

(57) ABSTRACT

A gutter for an evaporative panel of a cooling system having at least one channel with a bottom wall, a pair of opposing side walls ending at the top edges of the channel, at least one joint connecting one end of the channel to another component of the evaporative panel, the joint comprising, an outer part for coupling to an outer surface of the channel and having a pair of flanges to be arranged at the respective top edges of the channel, an inner part for coupling to an inner surface of the channel and having a pair of flanges to be arranged at the respective top edges of the channel, at least one gasket to be interposed between the inner part of the joint and the inner surface of the channel, and clamping to clamp the end of the channel between the inside and outside parts of the joint.

6 Claims, 5 Drawing Sheets

(56) References Cited

U.S. PATENT DOCUMENTS

| | | | | |
|---|---|---|---|---|
| 2017/0038104 | A1* | 2/2017 | Ko | F25B 39/00 |
| 2017/0167749 | A1* | 6/2017 | Murakami | F28F 1/20 |
| 2020/0378627 | A1* | 12/2020 | Nagashima | F25B 49/02 |

* cited by examiner

GUTTER FOR AN EVAPORATIVE PANEL OF A COOLING SYSTEM

The present invention refers in general to evaporative cooling systems, used, for example, for livestock and greenhouse facilities.

BACKGROUND

Such systems use water evaporation to cool the air that is circulated inside a barn or greenhouse by means of aeration systems. For this purpose, water-impregnated evaporative panels are used, which are arranged in openings made in the walls of the building and are made to be penetrated by a flow of air generated by an aeration system. The water in the panel evaporates, extracting heat from the surrounding air, and therefore the hot, dry air from the outside enters the cooler, more humid building. The water that does not evaporate, dripping downwards by gravity, collects in a gutter located below the panel, from which the water is drawn up by a pump and fed back to the distribution apparatus.

Evaporative panels generally are relatively large structures and are thus made by joining several elements together in order to cover the desired areas. In particular, the collection gutters are made by joining several consecutive elements in order to cover the entire width of the panel. The assembly generally takes place on site and provides for fixing and sealing the various elements of the gutter to each other. The fixing and sealing operation is carried out manually, and therefore the final result, in terms of sealing the gutter, depends on the skills of the operator. Moreover, it is also a time-consuming and resource-intensive process.

One object of the present invention is to make available a gutter for an evaporative panel of a cooling system that can overcome at least in part the aforementioned drawbacks.

BRIEF SUMMARY OF THE INVENTION

For this purpose, a gutter for an evaporative panel of a cooling system is the object of the invention, comprising

- at least one channel element comprising a bottom wall and a pair of opposing side walls extending from the bottom wall and ending at the respective top edges of the channel element, and
- at least one joint configured to connect one end of the channel element to another component of the evaporative panel, the joint comprising
- an outer part configured to be coupled to an outer surface of the channel element and provided with a pair of flanges suitable to be arranged at the respective top edges of the channel element,
- an inner part configured to be coupled to an inner surface of the channel element and fitted with a pair of flanges suitable to be arranged at the respective top edges of the channel element,
- at least one gasket suitable to be interposed between the inner part of the joint and the inner surface of the channel element, and
- clamping means acting on the flanges to clamp the end of the channel element between the inner part and outer part of the joint.

Preferred embodiments of the invention are defined in the dependent claims, which are intended as an integral part of the present description.

In a gutter according to the invention, the attachment of a channel element of the gutter to another component, such as another channel element or an end cap of the gutter, is achieved by means of a joint that may also ensure a seal between the elements. The joint thus facilitates assembly and sealing operations, for which the same level of expertise is not required as for conventional gutters. Moreover, assembly times are comparatively short.

BRIEF DESCRIPTION OF DRAWINGS

Further features and advantages of the gutter according to the invention will become more apparent in the following detailed description of an embodiment of the invention, made with reference to the accompanying drawings, provided purely to be illustrative and non-limiting, wherein.

DETAILED DESCRIPTION

Figure 1:
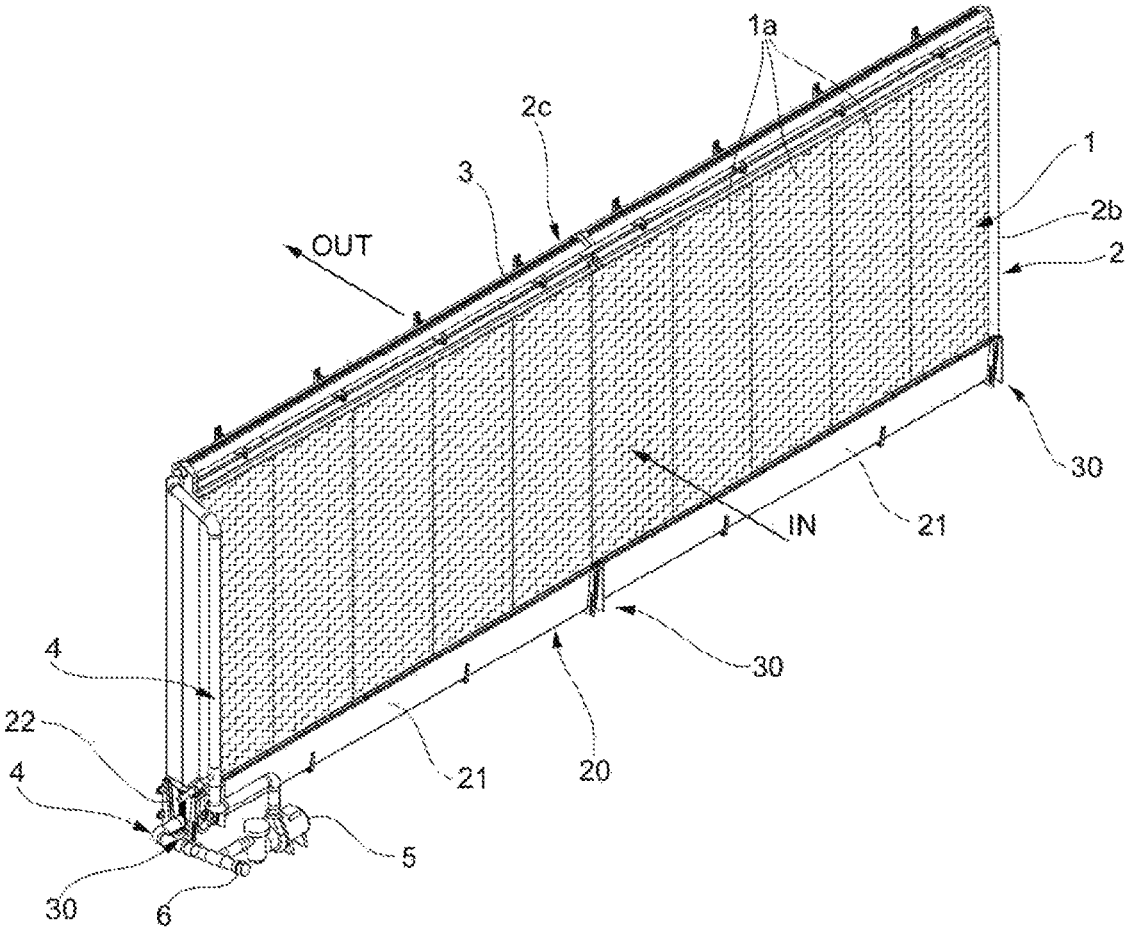
FIG. 1 is a perspective view of a cooling system with evaporative panel.
Figure 2:
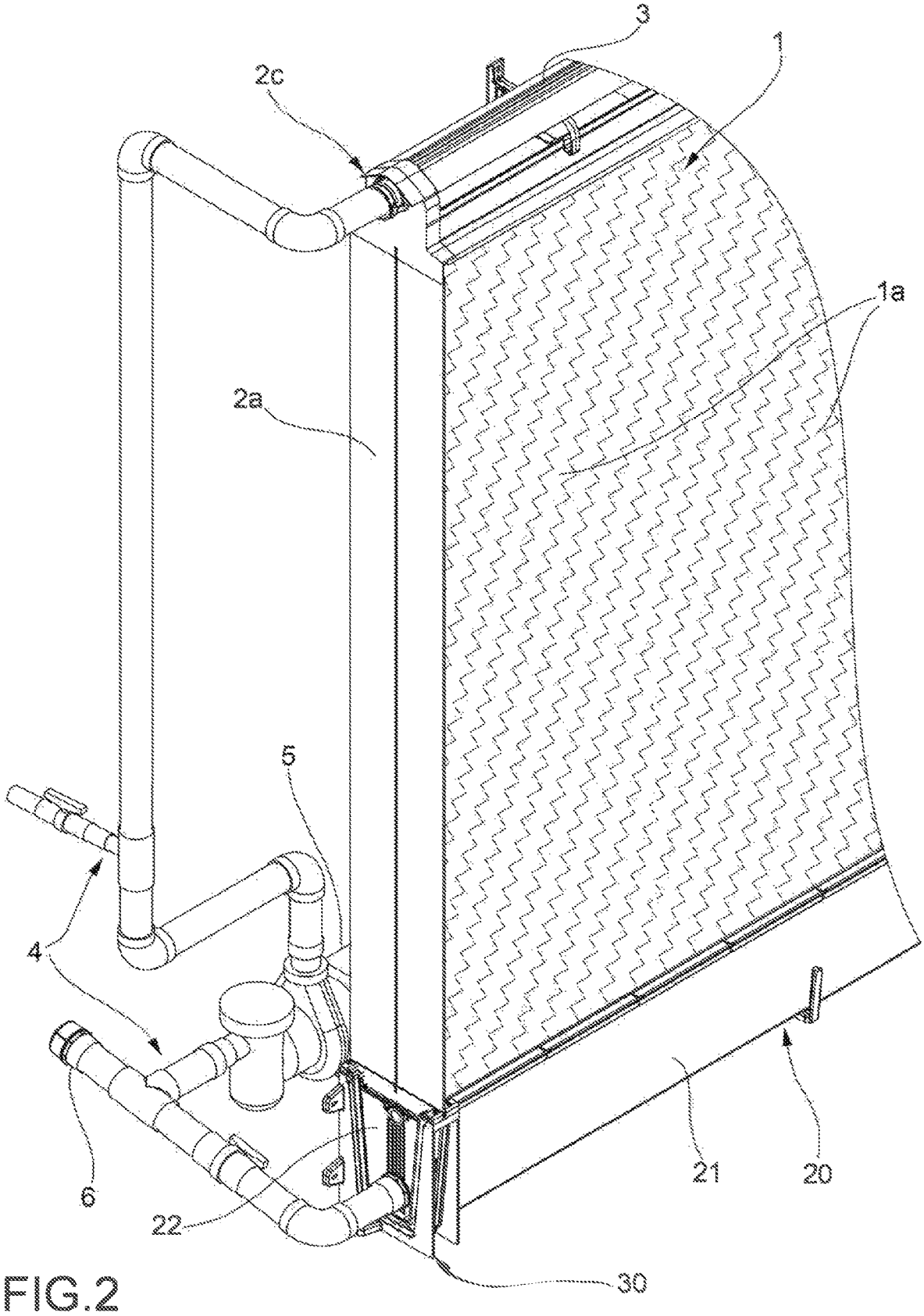
FIG. 2 is an enlarged scale view of a detail of the system.

With reference to FIGS. 1 and 2, an evaporative cooling system is represented. The system comprises an evaporative panel 1, formed by a plurality of panel elements 1*a* placed side by side and supported by a structure 2 that surrounds the panel 1. The elements of panel 1*a* are made of material chosen and configured in such a way as to allow, on the one hand, for them to be impregnated with water, and, on the other, for the air to pass through them. The direction of the air flow is represented by the IN and OUT arrows in FIG. 1.

The structure 2 comprises two side panels, 2*a* and 2*b*, between which the evaporative panel 1 is laterally contained. An upper part 2*c*, in which a distribution apparatus 3 is arranged, is constructed as a pipe that extends along the entire width of the panel 1 and equipped with a plurality of spray nozzles or other dispensing members (not shown) distributed along the pipe so as to spray the panel with water as evenly as possible.

The structure 2 further comprises a lower part 20 constructed as a gutter, and suitable to collect the water that drips by gravity from the panel 1.

The gutter 20 is conventionally connected to the distribution apparatus 3 by means of a recirculation pipe 4, comprising a pump 5 to draw the water from the gutter 20 and to feed it to the distribution apparatus 3.

The description of the aforesaid evaporative system is intended simply to frame the scope of the present invention and is therefore not to be considered binding.

Figure 3:
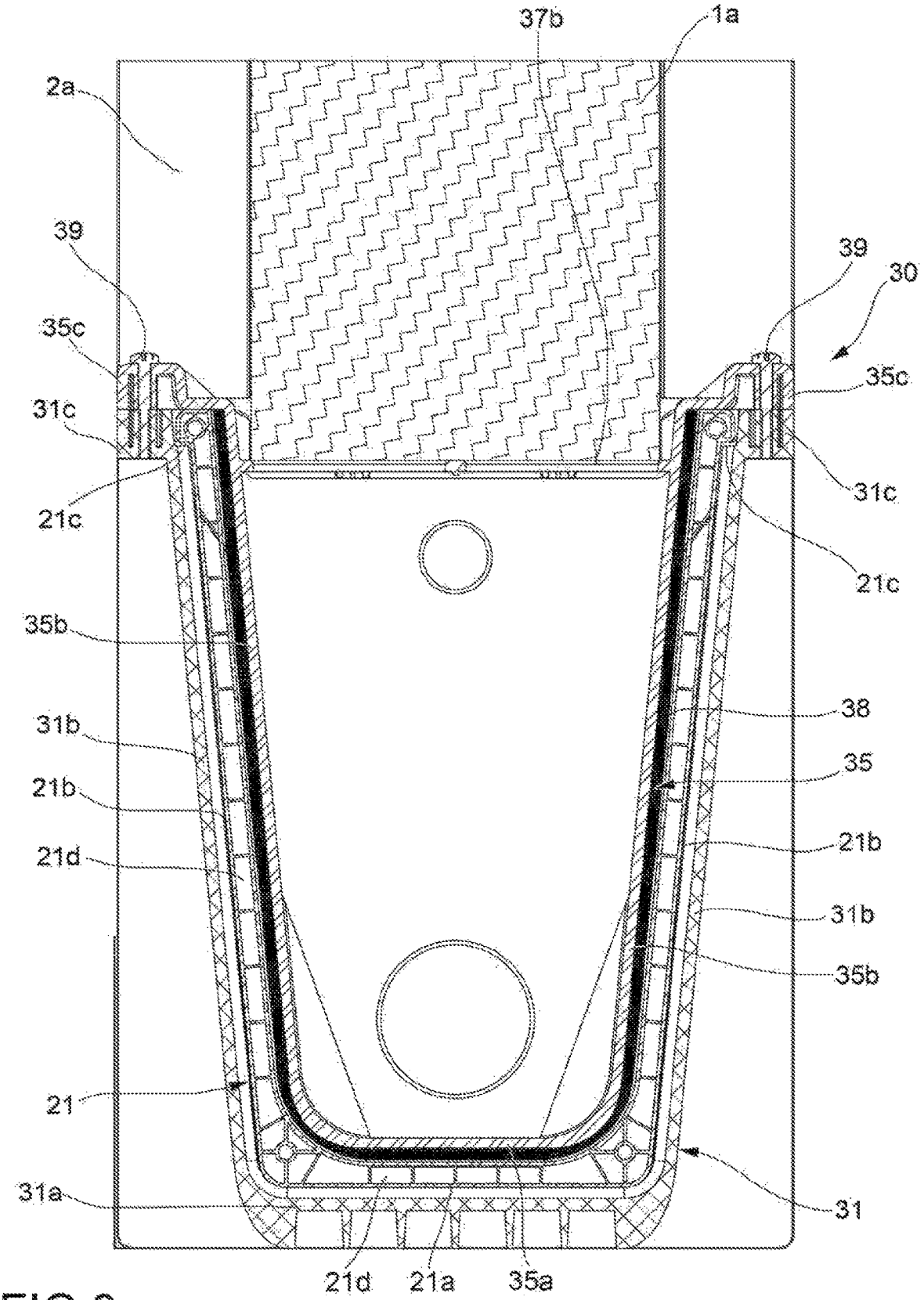
FIG. 3 is a cross-sectional view taken at a joint.
Figure 4:
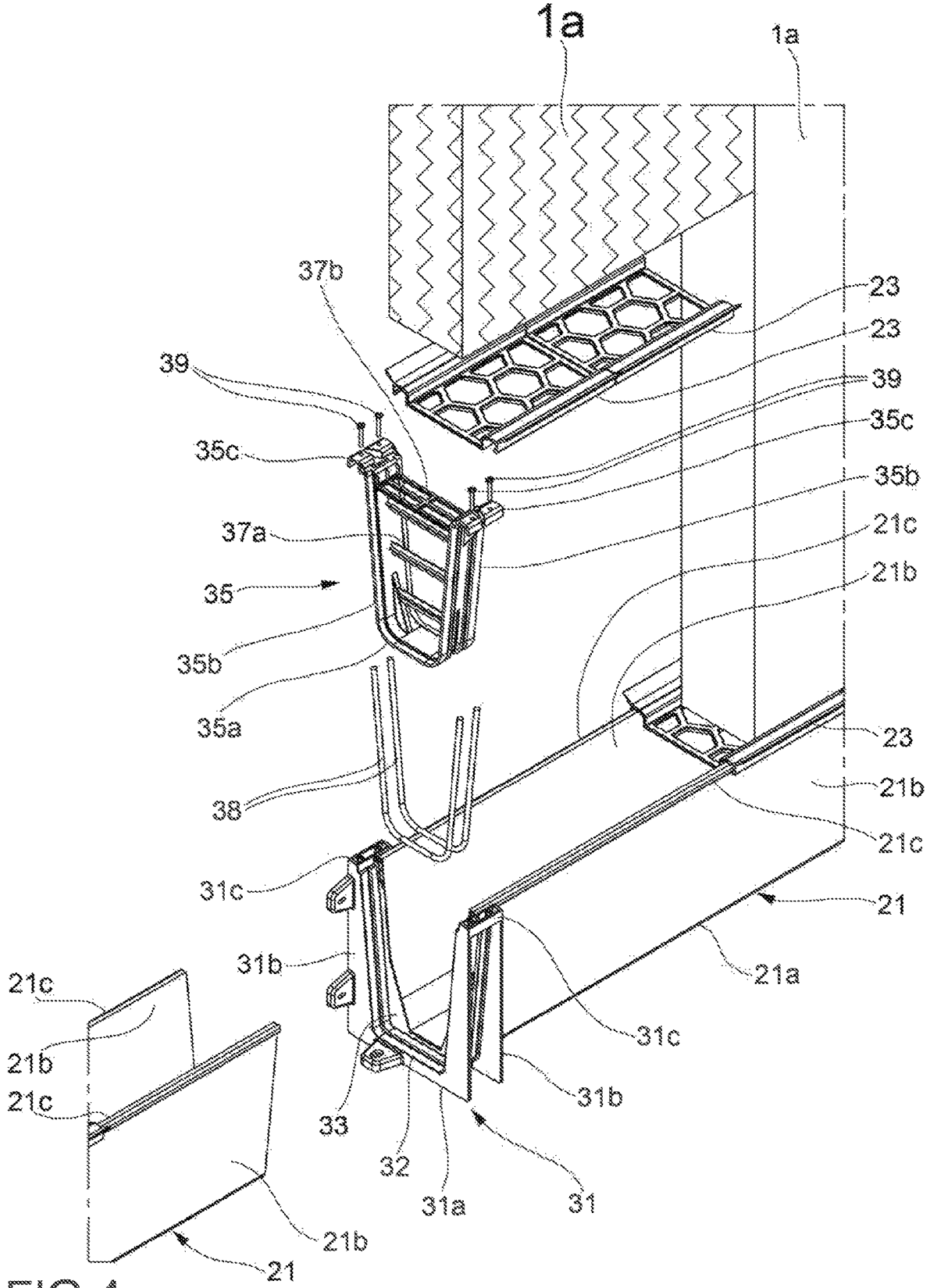
FIGS. 4 and 5 are exploded views of the joint.
Figure 5:
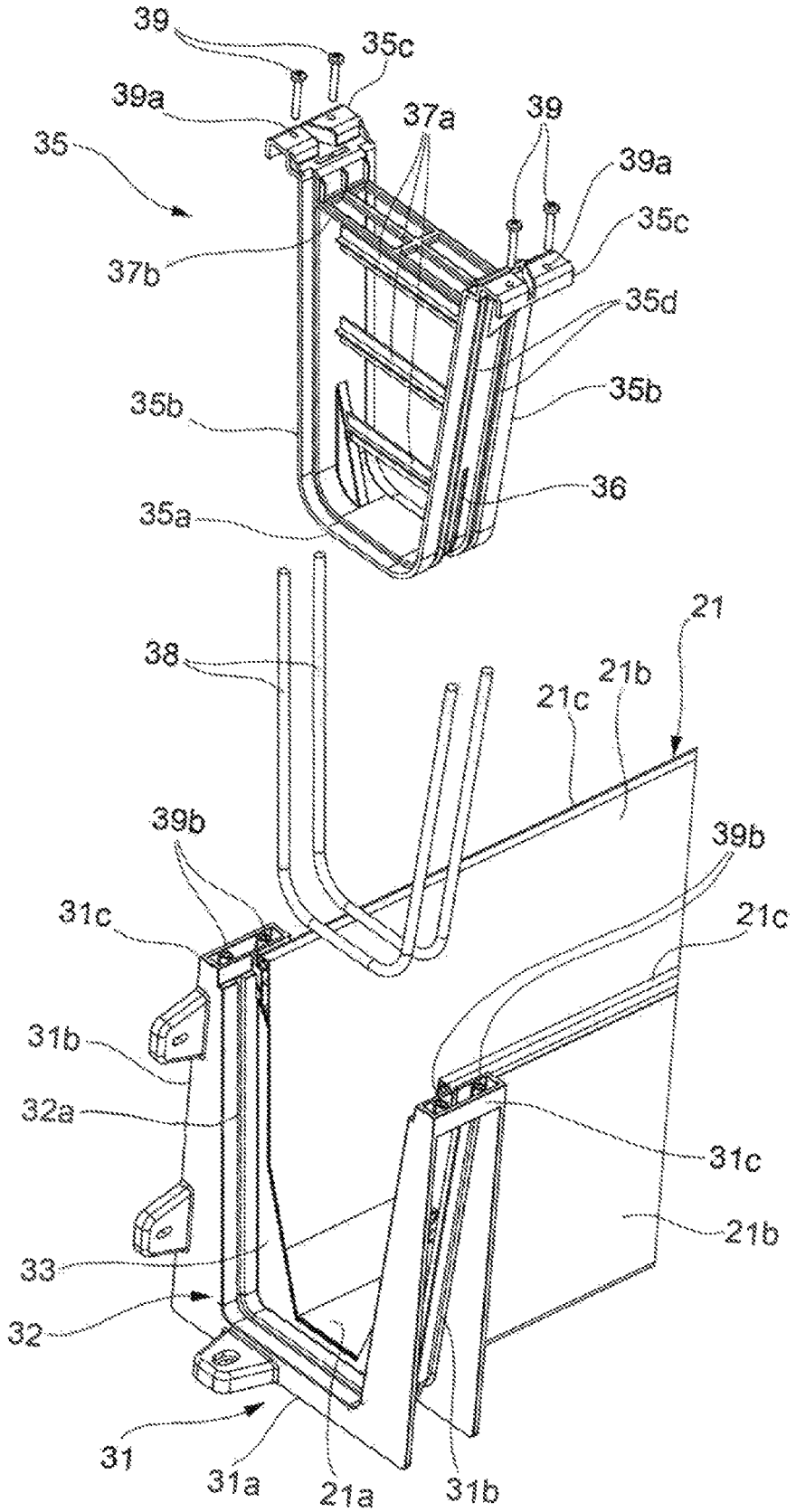

With particular reference to FIGS. 3 to 5, the gutter 20 comprises a plurality of consecutive channel elements 21. Each end of each channel element 21 is sealingly connected to one end of an adjacent channel element 21, or to another component of the panel, in particular an end cap of the gutter 21. FIGS. 1 and 2 show one of such end caps, indicated at 22, on which is arranged a fitting for connecting the gutter 21 to the recirculation pipe 4.

Each channel element 21 is made in a single piece, in particular, of plastic material, but could be made of other materials, such as metallic materials. In the example shown, the channel elements 21 have an approximately trapezoidal cross section. Such shape is not, however, essential to the invention and may be different, e.g. semicircular, parabolic or semi-elliptical, or more generally it may also have a non-symmetrical shape. Each channel element 21 consists of a bottom wall 21*a* and a pair of side walls 21*b* opposite each other that extend from the bottom wall 21*a* and end in respective top edges 21*c* of the channel element 21. As may be seen in particular in FIG. 3, each wall 21*a* and 21*b* is preferably constructed as a double wall with a cavity 21*d* inside. Such configuration is advantageous because it provides a double barrier that prevents water leaks to the outside in the event of cracks forming on the inside of the double wall.

As shown in FIG. 4, a series of consecutive grid elements 23 is arranged along the gutter 20, which rest on the top edges 21*c* of each channel element 21 and act as a support for the panel elements 1*a*, while at the same time allowing the water dripping from the panel elements 1*a* to collect in the gutter 20.

The sealed connection between the channel elements 21, and between the channel elements 21 and the end caps 22, is made by means of joints 30.

Each joint 30 comprises an outer part 31 formed as a single piece, in particular, made of plastic (or other materials), which is configured to be coupled to the outer surface of the channel element 21. Consequently, the outer part 31 of the joint has a shape that matches the cross-sectional profile of the outer surface of the channel element 21. The outer part 31 of the joint comprises a base portion 31*a*, which may be placed on a surface, and a pair of opposing side portions 31*b* that extend from the base portion 31*a*. At the top ends thereof, the side portions 31*b* end with their respective flanges 31*c* that extend laterally outwards. As may be seen in FIG. 3, in use, the flanges 31*c* are arranged at the respective top edges 21*c* of the channel element 21.

As may be seen in particular in FIGS. 4 and 5, the outer part 31 of the joint 30 has a seat 32 in the shape of a saddle, defined by the inner surfaces of the base portion 31*a* and the side portions 31*b* of the outer part 31. The seat 32 is suitable to receive the end of a respective channel element 21. The outer part 31, and in general the whole joint 30, may have reflective symmetry with respect to a median plane, so as to allow the coupling of two gutter elements 21 arranged head to head with a single joint 30 (the term "median" is understood to refer to the direction defined by the longitudinal axis of the channel element 21). The following description refers to only one of the symmetrical halves of the joint 30, but it is intended that the features described concern both halves. However, the invention is not limited to the symmetrical example described herein, as the joint may also have a non-symmetrical shape.

In the seat 32 of the outer part 31 of the joint 30, a partition 33 is preferably made, extending transversely inwards, arranged in particular at the median plane of the joint 30. The partition 33 defines a reference axial position, and possible abutment, for the end of the channel element 21 (and therefore, on opposite sides, for the ends of two channel elements 21 placed head to head). In this regard, it may be provided that the end of the channel element 21 must be placed at a certain axial distance from the partition 33, so as to have play that may compensate for the thermal expansion of the components that may occur in use.

In the seat 32 of the outer part 31 of the joint 30 a groove 32*a* may be obtained suitable to receive a possible gasket (not illustrated) to be interposed between the outer part 31 of the joint 30 and the outer surface of the channel element 21. According to other embodiments, there may be more than one gasket between the outer part 31 of the joint 30 and the outer surface of the channel element 21. Depending on other embodiments, the gasket(s) may be co-molded on the outer part 31 of the joint 30.

Each joint 30 comprises moreover an inner part 35 formed as a single piece, in particular, made of plastic (or other materials), which is configured to be coupled to the inner surface of the channel element 21. Consequently, the inner part 35 of the joint has a shape that matches the cross-sectional profile of the outer surface of the channel element 21. The inner part 35 of the joint 30 has a saddle shape and comprises a bottom portion 35*a* and a pair of opposing side portions 35*b* that extend from the bottom portion 35*a*. At the top ends thereof, the side portions 35*b* end with their respective flanges 35*c* extending laterally outwards. As may be seen in FIG. 3, in use, the flanges 35*c* of the inner part 35 of the joint 30 are arranged at the respective top edges 21*c* of the channel element 21 and are superimposed on the flanges 31*c* of the outer part 31 of the joint 30.

By virtue of the arrangement described above, in use, the end of the channel element 21 is sandwiched between the outer part 31 and the inner part 35 of the joint 30.

On each of the flanges 35*c* of the inner part 35 of the joint 30, there is a pair of inspection through-slits 35*e*, each of which in use is located above the top edge 21*c* of the end of the respective channel element 21. The inspection through-slits 35*e* are used to allow users to monitor, by observing through the slits 35*e* when the joint is closed, the positioning of the end of the channel element 21 with respect to the partition 33 made on the outer part 31 of the joint 30. For this purpose, it may be provided that each slit 35*e* is sized in length in such a way as to provide visual feedback regarding the positioning of the end of the channel element. In this case, it may be envisaged that, if the end of the channel element 21 is positioned too far from partition 33, then the slit 35*e* is "empty" inasmuch as, according to a plan view, there is no overlap between the slit 35*e* and the end of the channel element 21. Conversely, if the end of the channel element 21 comes into contact with the partition 33 due to incorrect positioning or thermal expansion of the channel element 21, then the slit 35*e* is "full" inasmuch as, according to a plan view, there is a total overlap between the slit 35*e* and the end of the channel element 21.

On the outer side of the inner part 35 of the joint 30, a slit 36 is preferably made to receive the partition 33 of the outer part 31 of the joint 30. Moreover, on the inner part 35 of the joint 30, one or more bridge portions 37*a*, 37*b* are made, extending between the side portions 35*b* of the inner part 35. Some of the bridge portions, indicated at 37*b*, serve to stiffen the inner part 35 of the joint 30 and to prevent the side portions 35*b* from flexing inwards in use, which would result in a loss of effectiveness of the compressive action of the inner part 35 of the joint 30 on the inner surface of the channel element 21. The upper bridge portion, indicated at 37*a*, is made as a grid and serves as a support for the overhanging panel element 1*a*.

On the outer side of the inner part 35 of the joint 30, a groove 35*d* may be obtained suitable to receive a respective gasket 38 to be interposed between the outer part 31 of the joint 30 and the outer surface of the channel element 21. According to further embodiments, there may be more than one gasket between the inner part 35 of the joint 30 and the inner surface of the channel element 21. According to other embodiments, the gasket(s) may be co-molded on the inner part 35 of the joint 30.

The joint 31 further comprises clamping devices 39 acting on the flanges 35*c* and 31*c* to clamp the end of the channel element 21 between the inner part 35 and outer part 31 of the joint 30. In the example shown, the clamping devices 39 are made as screws that are inserted into holes 39*a* made in the flanges 35*c* on the inner part 35 of the joint 30 and coupled to threaded holes 39*b* made in the flanges 31*c* on the outer part 31 of the joint 30. Clamping devices 39 may have other configurations. For example, they could be made as snap-on devices, or as clips or clamps that embrace and fasten the flanges 35*c* and 31*c* together.

The invention claimed is:

1. A gutter for an evaporative panel of a cooling system, comprising at least one channel element comprising a bottom wall and a pair of opposing side walls extending from the bottom wall and ending at the respective top edges of the channel element, and at least one joint configured to sealingly connect one end of the channel element to another component of the evaporative panel, the joint comprising an outer part configured to be coupled to an outer surface of the channel element and provided with a pair of flanges suitable to be arranged at the respective top edges of the channel element, an inner part configured to be coupled to an inner surface of the channel element and provided with a pair of flanges suitable to be arranged at the respective top edges of the channel element, at least one gasket suitable to be interposed between the inner part of the joint and the inner surface of the channel element, and clamping means acting on the flanges to clamp the end of the channel element between the inner part and outer part of the joint, wherein the outer part of the joint has a seat in the shape of a saddle, suitable to receive the end of the channel element, and the inner part of the joint comprises a corresponding bottom portion and a pair of opposing side portions extending from the bottom portion, wherein in the seat of the outer part of the joint a partition is made, extending transversely inwards, said partition defining a reference axial position for the end of the channel element, wherein on the inner part of the joint at least one bridge portion is made, extending between the side portions of the inner part, wherein said at least one bridge portion comprises an upper bridge portion made as a grid and serving as a support for a panel element of the evaporative panel.

2. A gutter according to claim 1, further comprising at least one gasket suitable to be interposed between the outer part of the joint and the outer surface of the channel element.

3. A gutter according to claim 1, wherein, on each flange of the inner part of the joint, an inspection through-slit is made, suitable to be placed above the respective top edge of the channel element to provide visual confirmation of the positioning of the end of the channel element with respect to the partition.

4. A gutter according to claim 1, wherein the joint has reflective symmetry with respect to a median plane.

5. A gutter according to claim 1, wherein the walls of the channel element are made as double walls.

6. A gutter according to claim 1, further comprising at least one grid element arranged along the gutter and resting on top edges of the at least one channel element, said grid element acting as a support for a panel element of the evaporative panel.

* * * * *